US005567064A

United States Patent [19]

Yeong

[11] Patent Number: 5,567,064

[45] Date of Patent: Oct. 22, 1996

[54] RIBBON CARTRIDGE

[75] Inventor: Wong C. Yeong, Jurong Town, Singapore

[73] Assignee: Fullmark Pte Ltd., Singapore

[21] Appl. No.: 499,473

[22] Filed: Jul. 7, 1995

[30] Foreign Application Priority Data

Aug. 7, 1994 [EP] European Pat. Off. ..... 94110664

[51] Int. Cl.[6] ..... B41J 32/02

[52] U.S. Cl. ..... 400/235.1; 400/196.1; 400/194

[58] Field of Search ..... 400/235, 235.1, 400/194–196.1

[56] References Cited

U.S. PATENT DOCUMENTS

| | | | |
|---|---|---|---|
| 4,011,933 | 3/1977 | Kern | 400/235.1 X |
| 4,088,218 | 5/1978 | Depew | 400/208 |
| 4,325,645 | 4/1982 | Miyajima et al. | 400/196.1 |
| 4,616,942 | 10/1986 | Nagasawa et al. | 400/196.1 |
| 4,636,097 | 1/1987 | Goubeaux | 400/196.1 |
| 4,732,500 | 3/1988 | Burgin | 400/208 |

FOREIGN PATENT DOCUMENTS

| | | | |
|---|---|---|---|
| 0106630 | 4/1984 | European Pat. Off. | 400/235.1 |
| 0428123 | 5/1991 | European Pat. Off. | 400/235.1 |
| 59-164179 | 9/1984 | Japan | 400/235.1 |
| 63-134279 | 6/1988 | Japan | 400/235.1 |
| 2190357 | 11/1987 | United Kingdom | 400/235.1 |

*Primary Examiner*—V. Millin
*Assistant Examiner*—Eric P. Raciti
*Attorney, Agent, or Firm*—Laubscher & Laubscher

[57] ABSTRACT

The present invention relates to a ribbon cartridge comprising a housing with an upper and a lower half, a ribbon received in said housing, a driving means comprising two driving gears for driving said ribbon, said driving gears rotatably supported in the housing and in engagement with each other for transporting the ribbon inbetween the driving gears. Specifically, the housing is provided with a bearing means for supporting a first one of said driving gears at a circumferential surface thereof in the middle of the height of said driving gear, so as to allow self-alignment of the driving gears with each other by adjustment movements other than a rotation around the axis of rotation.

13 Claims, 6 Drawing Sheets

A-A

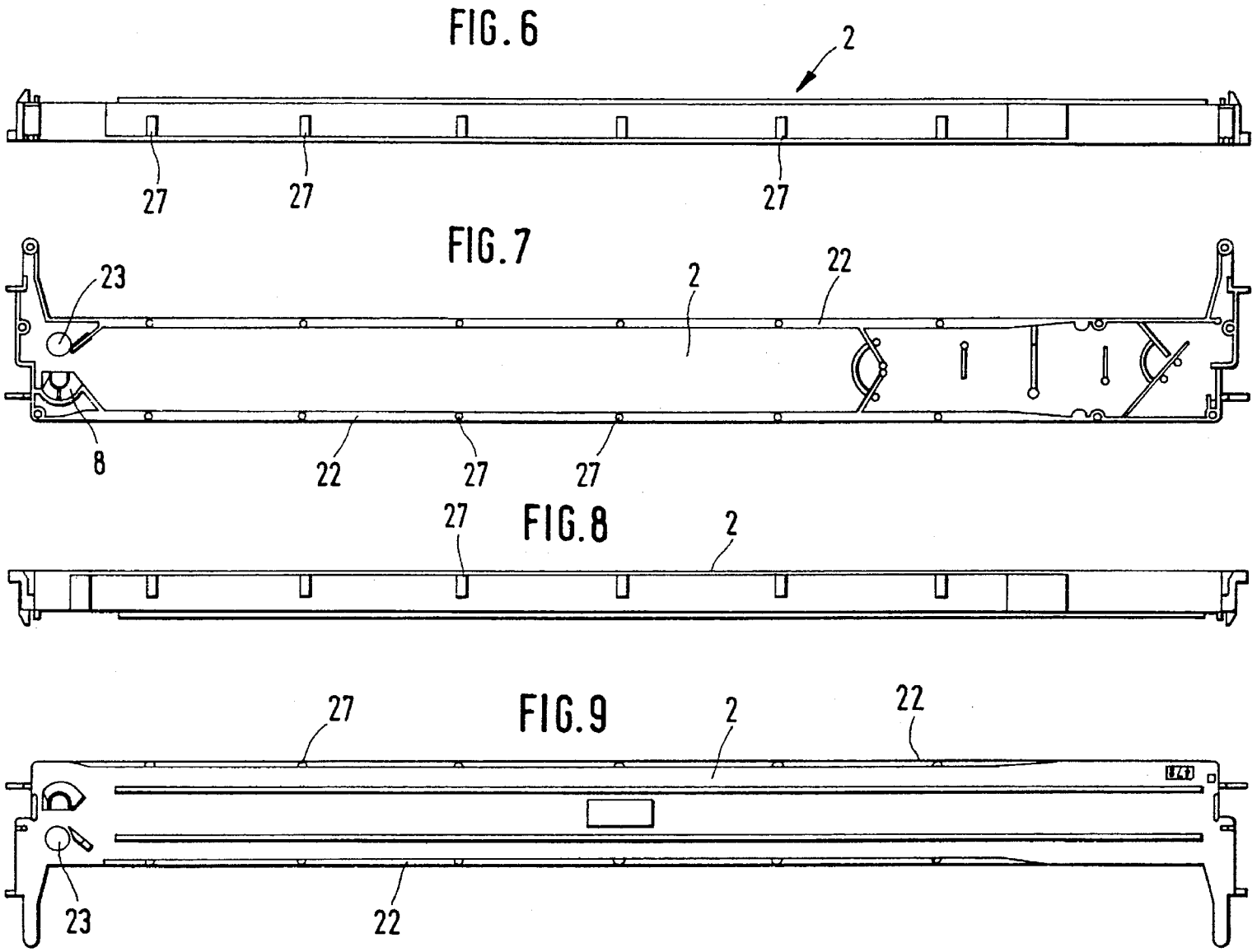
FIG. 6
FIG. 7
FIG. 8
FIG. 9
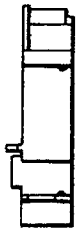
FIG. 10

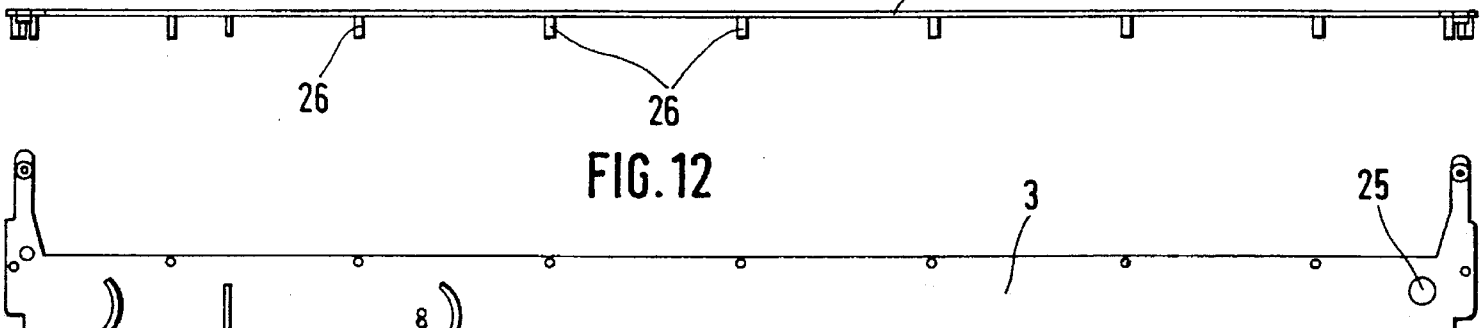
FIG. 11
FIG. 12
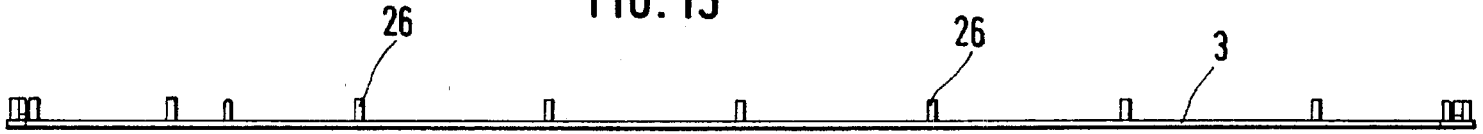
FIG. 13
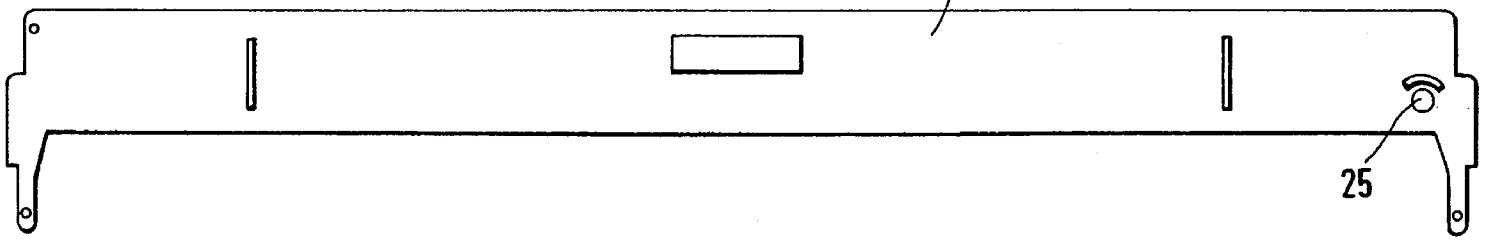
FIG. 14
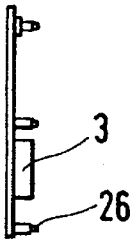
FIG. 15

RIBBON CARTRIDGE

BACKGROUND OF THE INVENTION

1. Field of the Invention

The present invention relates to a ribbon cartridge comprising a housing having a bottom half and a top half, a ribbon received in the housing, a driving means for driving the ribbon, the driving means having two cylindrical driving gears rotatably supported in the housing, the driving gears being in engagement with each other for transporting the ribbon in between the driving gears.

2. Description of the Prior Art

Ribbon cartridges containing a ribbon which is normally inked nylon fabric or carbon coated film are currently widely used in computer printers, typewriters, cash registers and other impact printing machines which transfer the printing agent, namely the ink or the carbon, to the printing medium in accordance with the printing mechanism of the printer. The ribbon is normally an endless loop which is transported in and out of the cartridges continuously to allow the printing mechanism to print on a fresh portion of the ribbon to provide clear print images such as text, graphics, etc.

From German Patent No. DE 31 38 828 C2 a conventional ribbon cartridge is known, which has a drive system consisting of two driving gears for transporting the ribbon. The driving gears are rotatably supported in a two-part housing and are in engagement with each other for transporting the ribbon in between said driving gears. The driving gears are rotatably supported on both the bottom half and the top half of the housing, so that their axis of rotation is fixed relative to the housing and therefore relative to each other when the two housing halves have been assembled. Since those driving gears are usually low-cost gears made of synthetic plastic material, problems arise owing to the fixed axis of the driving gears. The pressure on the contacting surfaces of the teeth meshing with each other is not constant over a contacting length in axial direction of the driving gears, so that the ribbon transported between the two driving gears is caused to climb toward the top half of the housing or to slide downwards toward the bottom half of the housing which results in the ribbon being folded or twisted. Thus, the quality of printing can be reduced or even worse the drive system can be jammed or the ribbon may be damaged.

SUMMARY OF THE INVENTION

It is therefore an objective of the present invention to provide a ribbon cartridge having a drive system which transports the ribbon precisely and reliably into and out of the cartridge continuously and in particular which prevents the ribbon from climbing to the top or sliding to the bottom so that it is neither folded nor twisted.

The objective of the present invention is performed by improving the ribbon cartridge in that the housing is provided with a bearing means for supporting a first one of said driving gears at a circumferential surface thereof in the middle of the height of said driving gear, so as to allow self-alignment of said driving gear with the second one of said driving gears by adjustment movements other than a rotation around the axis of rotation.

This embodiment of the bearing of the driving gear provides equal pressure on both the top portion and the bottom portion of the teeth meshing with each other. Thus, the driving gears drive the ribbon more precisely without the problem of the ribbon climbing to the top or sliding to the bottom so that the ribbon is neither folded nor twisted.

According to a preferred embodiment of the present invention the bearing means comprises a supporting protrusion integrally formed with the bottom half of the housing, said supporting protrusion extending towards said first driving gear in parallel with the bottom wall of said bottom half at a certain height thereabove and having an arcuate recess receiving said first driving gear. Thus, no additional part for supporting the driving gear is necessary, thereby reducing the cost of assembling the ribbon cartridge. Moreover, the driving gear nestles in the arcuate recess of the supporting protrusion, so that it can smoothly rotate and mesh with the other driving gear.

Preferably the supporting protrusion extends from a supporting wall which is integral with and perpendicular to the bottom wall of the bottom half and has a curved shape following partially the circumference of the first driving gear. This reduces the self-supporting length of the supporting protrusion and reduces the maximum load on said supporting protrusion, since the momentum owing to leverage is small, so that the supporting protrusion can be thin.

In a preferred embodiment of the present invention, the first driving gear is provided with a circumferential groove, the centre shaft of which is in engagement with said supporting protrusion. The driving gear is thereby precisely located and on the other hand the tooth tips of the driving gear are not worn off by the supporting protrusion.

In this respect it is advantageous that the portion of the supporting protrusion delimiting the arcuate recess has a thickness in axial direction greater than the thickness of a body portion of said supporting protrusion, because a contact surface of the supporting protrusion contacting the driving gear is increased and thereby the wear rate of both the supporting protrusion and the driving gear is reduced. Thus the life of the drive mechanism is extended. The aforementioned thickness in axial direction is still small enough to provide a clearance between the supporting protrusion and the groove to allow self-alignment of the first driving gear with the second driving gear by adjustment movements in particular around an axis perpendicular to the axis of rotation of the driving gears and thereby to produce equilibrium pressure along the contact line between the teeth meshing with each other.

In accordance with a preferred embodiment of the present invention, a rejector finger extends essentially tangentially to the circumference of the first driving gear to prevent the ribbon from coiling around said first driving gear. Preferably a lateral edge of the supporting protrusion embodies said rejector finger and extends essentially tangentially to the circumference of said first driving gear. As a result, the ribbon cannot stick to the driving gear and is reliably transported inbetween the two driving gears.

The second driving gear is, according to a preferred embodiment, rotatably supported by the bottom half and the top half of the housing by means of a fixed bearing. Either the driving gear or the bottom half and/or the top half is provided with a circular protrusion to engage with a recess or opening in either the bottom half and/or the top half or in the second driving gear. Such a fixed bearing fixes the axis of rotation of the second driving gear in a very simple way which reduces the cost of the ribbon cartridge. That is specially advantageous because the second driving gear is connected to a driving mechanism of the printer or the typewriter, so that it is convenient that its position is fixed relative to the ribbon cartridge.

In order to feed the ribbon manually and to take up the slack on the ribbon when installing the cartridge to printers and typewriters, the second driving gear is in a preferred embodiment provided with a turning knob extending through a hole in the top half of the housing. The turning knob is fitted in said hole in the top half and thereby serves at the same time as pivot bearing for the second driving gear.

A preferred embodiment of the present invention includes a rejector arm extending essentially tangentially to the circumference of the second driving gear to prevent the ribben from coiling around said second driving gear in a manner similiar to the above-described rejector finger associated with the first driving gear. The second driving gear is therefore provided with a circumferential groove from which the rejector arm integrally formed with the bottom half of the housing extends substantially tangentially to the bottom of said groove.

In order to allow the supporting protrusion to be moulded in one piece with the bottom half, a first opening is formed according to a preferred embodiment in the bottom wall of the bottom half below the supporting protrusion, which opening is shaped substantially correspondingly to the shape of the supporting protrusion. A mould for moulding the bottom half of the housing can therefore be simple, since no movable core is necessary for moulding the supporting protrusion in parallel with the bottom wall of the bottom half.

Preferably, a second opening is correspondingly formed in the bottom wall of the bottom half below the rejector arm. This second opening is shaped substantially correspondingly to the shape of the rejector arm according to a preferred embodiment of the present invention. Accordingly, the mould needs no movable core for moulding the rejector arm.

In accordance with a preferred embodiment of the present invention, the top half and the bottom half of the housing are provided with positioning pins and positioning holes for connecting and positioning the top half and the bottom half relative to each other. By means of said positioning pins and positioning holes the assemblage of the ribbon cartridge is very convenient and quick, and moreover, the two halves can be positioned very exactly relative to each other, which is important because the second driving gear is rotatably supported by both the bottom half and the top half.

Preferrably, the positioning pins are integrally formed with the top half or the bottom half, so that they can be moulded together with the top half or the bottom half and no further assembling step is necessary.

BRIEF DESCRIPTION OF THE DRAWINGS

Hereinafter, the present invention is illustrated and explained in greater detail by a preferred embodiment in conjunction with the accompanying drawings, wherein:

FIGS. 6–10 are front, top, rear, bottom and left hand end views, respectively, of the bottom half of the cartridge of FIG. 1; and FIGS. 11–15 are front, bottom, rear, top and left hand end views, respectively, of the top half of the cartridge.

DETAILED DESCRIPTION

Figure 1:
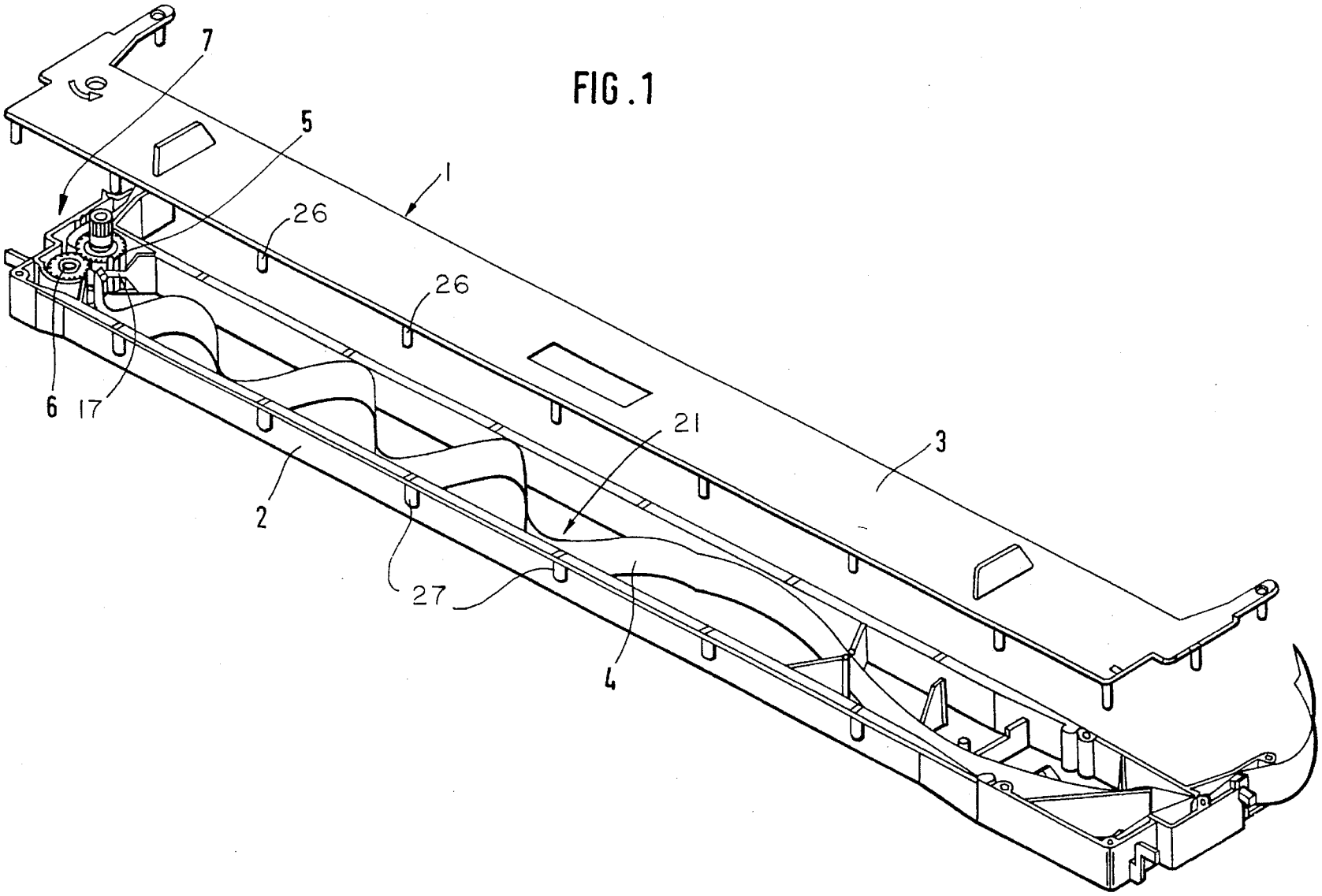
FIG. 1 is a perspective partially-exploded view a ribbon cartridge according to an embodiment of the present invention.
Figure 2:
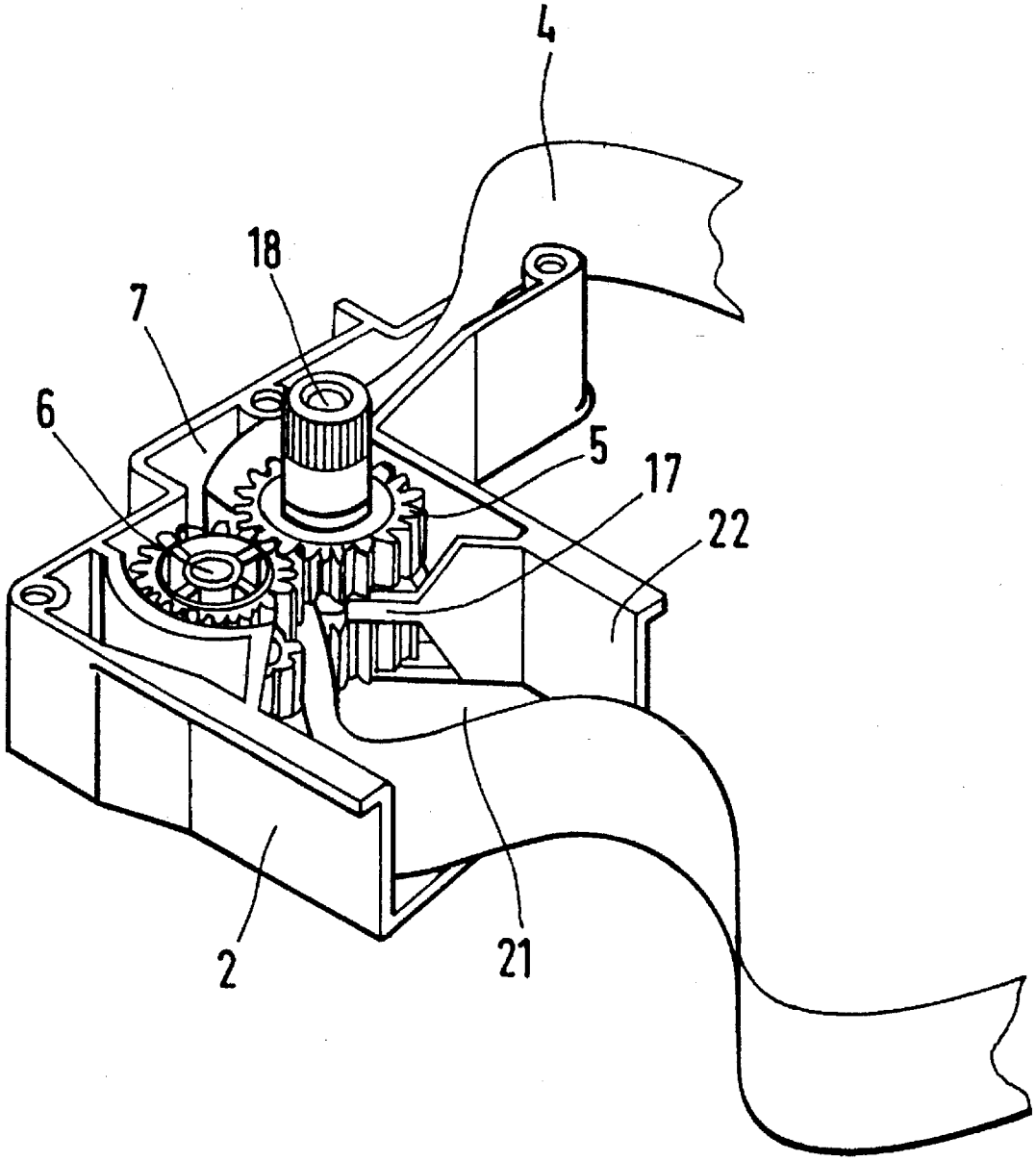
FIG. 2 is a detailed perspective view indicating the location and assembly of driving gears and a ribbon in a cartridge housing according to the embodiment of FIG. 1

Referring to FIGS. 1 and 2, a driving means 7 of a ribbon cartridge according to the present invention is received in a bottom half or section 2 of a housing 1. The driving means 7, comprises a first driving gear 6 and a second driving gear 5, which are in engagement with each other. A ribbon 4 is transported in and out of the housing 1 in order to feed a printing mechanism of a printer or a typewriter which are not shown with a fresh portion of the ribbon 4 to provide clear print images. The ribbon 4 is transported inbetween the first driving gear 6 and the second driving gear 5 in a direction leading into a holding space 21 in which the ribbon 4 is arranged in loops. The first driving gear 6 is therefore rotated clockwise while the second driving gear 5 is rotated counterclockwise. It is to be noted, however, that the rotary direction depends on the side on which the driving means 7 is provided. If the driving means 7 is provided on the opposite side of the holding space 21, the first and second driving gears 6, 5 are rotated in the opposite rotary direction.

Figure 4:
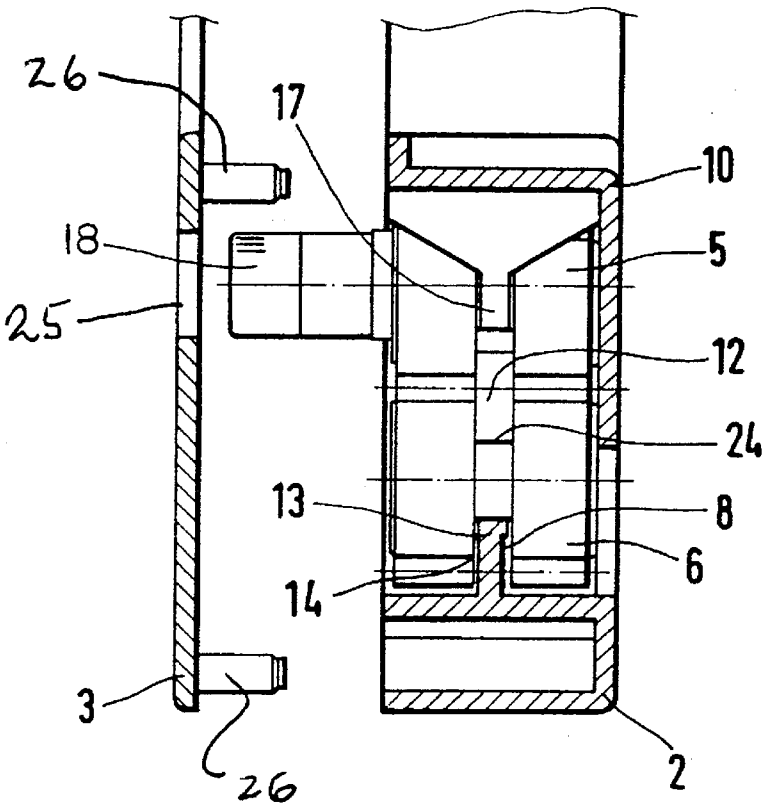
FIG. 4 is a sectional view taken along the line A—A of FIG. 3.
Figure 3:
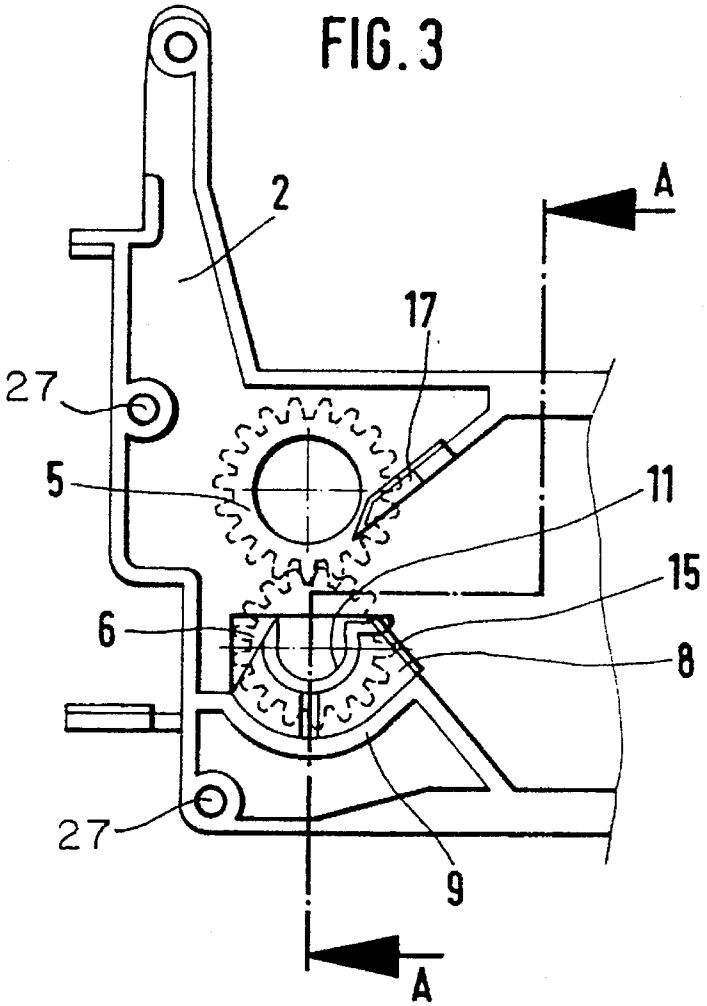
FIG. 3 is a detailed top plan a top view of the assembly of the driving gears supported in the housing according to the embodiment of FIG. 1.

The second driving element 5 is, as may be best seen in FIGS. 3 and 4, supported by both the bottom half or section 2 and the top half or section 3 of the housing 1 to enable it to maintain its alignment at a fixed vertical axis. At the bottom, the second driving gear 5 is provided with a pivot which is received in an opening 23 in the bottom half 2 of the housing 1. On its upper side, the second driving gear 5 is provided with a turning knob 18 extending through a hole 25 in the top half 3 of the housing 1. The turning knob 18 is snugly fitted in said hole 25 in the top half 3 of the housing 1 so that the turning knob 18 serves as a pivot bearing on the upper side of the second driving gear 5. To serve its actual purpose the turning knob 18 is used for feeding the ribbon 4 manually to take up the slack on the ribbon 4 when installing the cartridge to a printing machine.

The first driving gear 6 which is driven by the second driving gear 5, is also supported by the bottom half 2 of the housing 1. As may be best seen in FIGS. 3 and 4, a supporting protrusion 8 is integrally formed with the bottom half 2 of the housing 1. Said protrusion 8 extends from a supporting wall 9 towards said first driving gear 6 in parallel with the bottom wall 10 of the bottom half 2 at a certain height thereabove and has an arcuate recess 11 which receives the first driving gear 6. The first driving gear 6 has therefore a circumferential groove 12, the centre shaft 24 of which is in engagement with the recess 11 of the supporting protrusion 8. The groove 12 is located in the middle of the length of the first driving gear 6, so that the pressure on the contact surfaces of the meshing teeth of the first driving gear 6 and the second driving gear 5 is equal at the bottom portion close to the bottom wall 10 and at the top portion of the teeth close to the top half 3 to prevent the ribbon 4 from climbing towards the top half 3 or slipping towards the bottom half 2 of the housing 1 what would result in the ribbon 4 being folded or twisted.

As may be best seen in FIG. 4, the supporting protrusion 8 has a portion 13 delimiting the arcuate recess 11, which portion 13 has a thickness in axial direction greater than the thickness of a body portion 14. The increased thickness of the portion 13 provides an increase in the contact surface of the supporting protrusion 8 and the first driving gear 6 to reduce the wear and tear of both the supporting protrusion 8 and the first driving gear 6, thus extending the life of the drive mechanism.

In order to allow adjustment movements other than the rotation around the axis of rotation, there is clearance between the supporting protrusion 8 and the first driving gear 6, so that the first driving gear 6 may self-align with the second driving gear 5 which is supported with the fixed axis of rotation relative to the housing 1. The self-alignment of the first driving gear 6 compensates any manufacturing inaccuracy and enables the top and bottom layer of the contact surface of the first driving gear 6 to be engaged with the second driving element 5 with equilibrium pressure. Thus, the ribbon 4 can be transported more precisely without the problem of the ribbon 4 climbing towards the top or slipping down towards the bottom of the housing 1.

Referring to FIG. 3, the supporting protrusion 8 is shaped in such a way that a lateral edge 15 serves as a rejector finger and extends essentially tangentially to the circumference of said first driving gear 6. Said lateral edge is in fact tangential to an imaginary circumference which is smaller in diameter than the circumference of the first driving gear 6 defined by the tooth tips, so the lateral edge 15 separates the ribbon 4 from the first driving gear 6 and prevents the ribbon 4 from coiling around said first driving gear 6.

Correspondingly a rejector arm 17 associated with the second driving gear 5 extends essentially tangentially to a circumference of the second driving gear 5. The second driving gear 5 is therefore provided with a circumferential groove 16 from which the rejector arm 17 extends substantially tangentially to the bottom of said groove 16. The rejector arm 17 is integral with a wall 22 defining the holding space 21 for storing the ribbon 4.

The aforementioned lateral edge 15 of the supporting protrusion 8 is substantially aligned with a bend in the supporting wall 9 which supports the supporting protrusion 8 at a raised height above the bottom wall 10 of the bottom half 2. Said supporting wall 9 is integral with and perpendicular to the bottom wall 10 of the bottom half 2 and has a curved shape following partially the circumference of the first driving gear 6. That allows the supporting protrusion 8 to be embodied as a thin web, since the self-supporting length of the supporting protrusion 8 between the arcuate recess 11 and the supporting wall 9 is short, so that the load applied by the first driving gear 6 on the recess 11 results only in a small leverage. Thus, the bearing means 8 for supporting the first driving gear 6 is compact and light.

Figure 5:
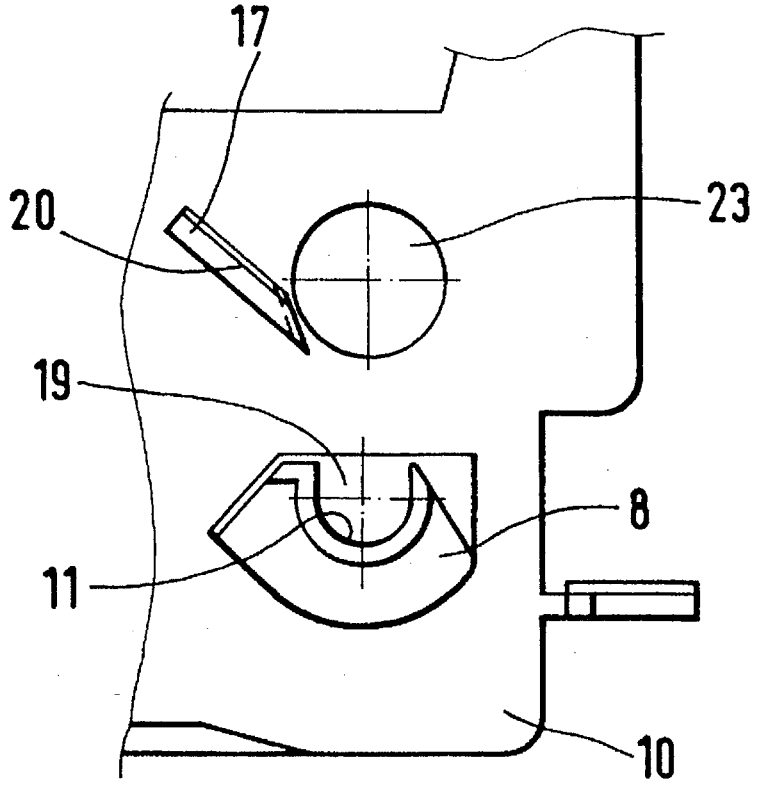
FIG. 5 is a detailed bottom view of the embodiment of FIGS. 1–4, with certain parts removed.

Referring now to FIGS. 5, 7 and 9, which show the bottom half 2 of the housing 1 in a bottom and top view, it can be seen that the bottom half 2 is provided with a first opening 19 in the bottom wall 10 below the supporting protrusion 8, which first opening 19 is shaped essentially correspondingly to the shape of the supporting protrusion 8. Since the bottom half 2 of the housing 1 (and also the top half 3) is moulded, preferably made of synthetic plastic material, the supporting protrusion 8 can be moulded in one piece with the bottom half 2 by means of a simple and thereby inexpensive mould without a movable core.

Additionally, the bottom half 2 is in a similiar way provided with a second opening 20 which is formed in the bottom wall 10 below the rejector arm 17 and which is shaped as a slot, correspondingly to the shape of the rejector arm 17. Owing to said second opening 20, the rejector arm 17 can also be moulded in one piece with the bottom half 2 by means of a mould without a movable core. A lower half of the mould for the bottom half 2 of the housing 1 needs therefore only a protrusion extending through the bottom wall 10 to mould the rejector arm 17 and the supporting protrusion 8, respectively.

As may be best seen in FIGS. 11 to 15, the top half 3 of the housing 1 is provided with positioning pins 26 which fit into corresponding positioning holes or bores 27 provided in the bottom half 2 of the housing 1 as may be best seen in FIGS. 6 to 9. These positioning holes 27 are formed in side walls 22 defining the essentially tray-shaped bottom half 2. The positioning pins 26 are integrally formed with the top half 3 and snuggly fit into the corresponding positioning holes 27, so that the bottom half 2 and the top half 3 are connected to each other by means of these positioning pins 26 and positioning holes 27 which moreover accurately position the top half 3 and the bottom half 2 relative to each other. That is important because the second driving gear 5 is supported by both the top half 3 and the bottom half 2, so that an inaccurate position of the top half 3 relative to the bottom half 2 would result in the axis of rotation of the second driving gear 5 being inclined.

With the ribbon cartridge having the driving means structure according to the present invention, a simple and reliable transport of the ribbon is achieved, which driving means structure prevents the ribbon from being folded or twisted, as it does not climb or slide towards the top and bottom half of the housing, respectively, in particular because of the self-alignment of the first driving gear with the second driving gear.

I claim:

1. A ribbon cartridge for longitudinally feeding a ribbon, comprising:

(a) a sectional housing (1) containing a chamber (21) having inlet and outlet openings, said housing including bottom (2) and top (3) sections;

(b) driving means arranged in said chamber for longitudinally transporting the ribbon through said chamber, said driving means including first and second generally parallel cylindrical cooperating driving gears (5,6) between which the ribbon is received, said first driving gear (6) containing intermediate its ends a peripheral groove (12) having opposed side walls and a bottom wall defining in said first gear a center support shaft (24); and (c) means supporting said first driving gear for pivotal adjustment relative to said second driving gear about an axis normal to a plane containing the longitudinal axes of said driving gears, said support means including a support protrusion (8) carried by said housing and extending within said chamber adjacent said first driving gear, said support protrusion having:

(1) a body portion (14) connected with said housing and extending within said chamber and within said first gear groove in spaced relation relative to said groove side walls; and (2) a thickened end portion (13) in supporting engagement with said center support shaft.

2. Apparatus as defined in claim 1, wherein said housing is molded from a synthetic plastic material; and further wherein said protrusion extends upwardly from a first opening (19) formed in the bottom wall of said bottom housing section.

3. Apparatus as defined in claim 1, and further including means supporting said second driving gear for rotation about a fixed longitudinal axis, said second driving gear including a shaft extending axially within a corresponding opening (23) contained in one of said housing sections.

4. Apparatus as defined in claim 3, wherein said second driving gear includes an axially-extending tuning knob (18) that extends within a corresponding opening (25) contained in the other of said housing sections.

5. Apparatus as defined in claim 1, wherein the adjacent surfaces of said top and bottom sections are provided with cooperating positioning pins (26) and positioning holes (27), respectfully.

6. Apparatus as defined in claim 5, wherein said positioning pins are integral with said top housing section.

7. A ribbon cartridge as defined in claim 1, wherein said housing bottom section is generally tray-shaped and includes bottom (10) and side (9) walls, said support protrusion being carried by said bottom section side wall and extending in parallel spaced relation relative to said bottom section bottom wall.

8. A ribbon cartridge as defined in claim 7, wherein the portion (9) of said bottom section side wall adjacent said first driving gear is concave and corresponds generally with the periphery of said first driving gear, thereby to define a cavity within which said first driving gear is arranged.

9. A ribbon cartridge as defined in claim 8, and further wherein said concave side wall portion extends generally tangentially relative to the circumference of said first driving gear.

10. A ribbon cartridge as defined in claim 9, wherein said support protrusion includes an edge portion (15) that extends generally tangentially of said first driving gear.

11. Apparatus as defined in claim 1, wherein said housing includes a rejector arm (17) that extends tangentially relative to the circumference of said second driving gear, thereby to prevent said ribbon from coiling around said second driving gear.

12. Apparatus as defined in claim 11, wherein said second driving gear contains a peripheral groove into which said rejector arm extends.

13. Apparatus as defined in claim 11, wherein said housing is molded from synthetic plastic material, and further wherein said rejector arm extends upwardly from a second opening (20) contained in the bottom housing section.

* * * * *

UNITED STATES PATENT AND TRADEMARK OFFICE

CERTIFICATE OF CORRECTION

PATENT NO. : 5,567,064

DATED : October 22, 1996

INVENTOR(S) : Wong C. Yeong

It is certified that error appears in the above-identified patent and that said Letters Patent is hereby corrected as shown below:

On the title page item [30],

In the Foreign Application Priority Date, change "Aug. 7, 1994" to --July 8, 1994--.

Signed and Sealed this

Twenty-ninth Day of April, 1997

*Attest:*

*Attesting Officer*

BRUCE LEHMAN

*Commissioner of Patents and Trademarks*